US007001146B1

(12) United States Patent
Todd

(10) Patent No.: US 7,001,146 B1
(45) Date of Patent: Feb. 21, 2006

(54) ELECTRIC FAN COOLING OF HYDRAULIC PUMP

(75) Inventor: Michael Todd, Sullivan, IL (US)

(73) Assignee: Hydro-Laser Limited Partnership, Sullivan, TX (US)

( * ) Notice: Subject to any disclaimer, the term of this patent is extended or adjusted under 35 U.S.C. 154(b) by 150 days.

(21) Appl. No.: 10/749,709

(22) Filed: Dec. 31, 2003

(51) Int. Cl.
*F01D 25/10* (2006.01)

(52) U.S. Cl. ..... 415/175; 415/121.3

(58) Field of Classification Search ..... 415/175, 415/176, 47; 416/169 A, 39
See application file for complete search history.

(56) References Cited

U.S. PATENT DOCUMENTS 3,853,193 A * 12/1974 Dunn ..... 60/456
3,937,192 A * 2/1976 Longhouse ..... 415/175
4,206,029 A 6/1980 Spirig
5,794,422 A 8/1998 Reimers et al.
6,589,029 B1 7/2003 Heller
6,592,336 B1 7/2003 Hirano et al.

FOREIGN PATENT DOCUMENTS

JP 11278065 A * 10/1999

* cited by examiner

*Primary Examiner*—Edward K. Look
*Assistant Examiner*—Richard A. Edgar
(74) *Attorney, Agent, or Firm*—Neal, Gerber & Eisenberg LLP

(57) ABSTRACT

An assembly and means for cooling a hydraulic pump comprising an electric fan mounted on a housing of the hydraulic pump. An upper shroud helps direct cooler air to the fan and helps prevent inadvertent contact with the fan blades. An optional controller can be attached that senses the temperature of the hydraulic pump and adjusts the speed of the fan accordingly.

14 Claims, 4 Drawing Sheets

ELECTRIC FAN COOLING OF HYDRAULIC PUMP

BACKGROUND OF THE INVENTION

This invention relates to cooling of a hydraulic pump by means of an electric fan mounted on the pump.

SUMMARY OF THE INVENTION

The invention disclosed herein comprises an electric fan mounted directly to a hydraulic pump to provide cooling for the pump. Cooling is typically provided either by a cooler separate from the pump, or by a fan mounted on an input shaft. An electric fan allows positioning of the fan in a multitude of locations on the pump. By the addition of a thermostat the speed of the fan may be matched to the temperature of the pump, thus minimizing the energy used for cooling the fan.

Other benefits and objects of this invention are disclosed herein and will be obvious to readers of ordinary skill in the art. The features disclosed herein can be combined to create a unique design; it is understood, however, that such features are unique in their own right and can be used independently with other transmission transaxle or vehicle designs, as will be obvious to one of ordinary skill in the art.

DETAILED DESCRIPTION OF THE DRAWINGS

Figure 1:
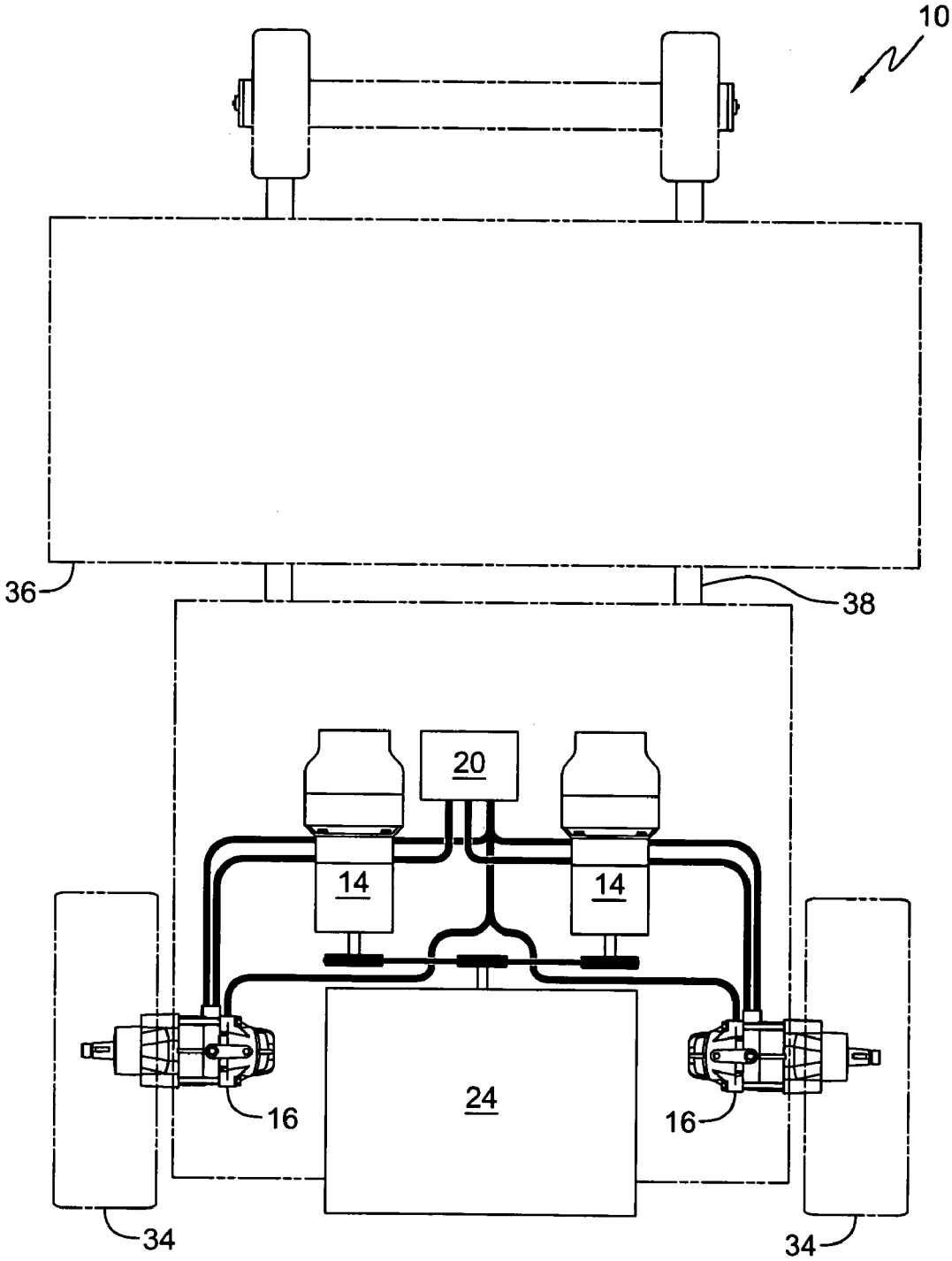
FIG. 1 is a top plan view of a vehicle including a pair of hydraulic pumps incorporating a first embodiment of the present invention.

FIG. 1 shows a typical vehicle 10 having an engine 24 mounted on a vehicle frame 38, mowing deck 36 and rear drive wheels 34. A pair of hydraulic pumps 14 mounted on vehicle 10 are connected to motors 16 to drive wheels 34 in a known manner.

The operation of hydraulic pumps such as are disclosed herein is well known and will not be described in detail herein. Such pumps are shown in U.S. Pat. Nos. 6,332,393 and 6,526,748, which are commonly owned with this application and which are incorporated herein by reference. In general pump 14 comprises an external housing 18 and is driven either directly or indirectly by engine 24 by means of a shaft or one or more belts and pulleys. Pump 14 may be attached to a sump 20 and additional elements such as an oil filter (not shown). Pump 14, motor 16 and sump 20 may then be connected to each other by various hydraulic lines.

Figure 2:
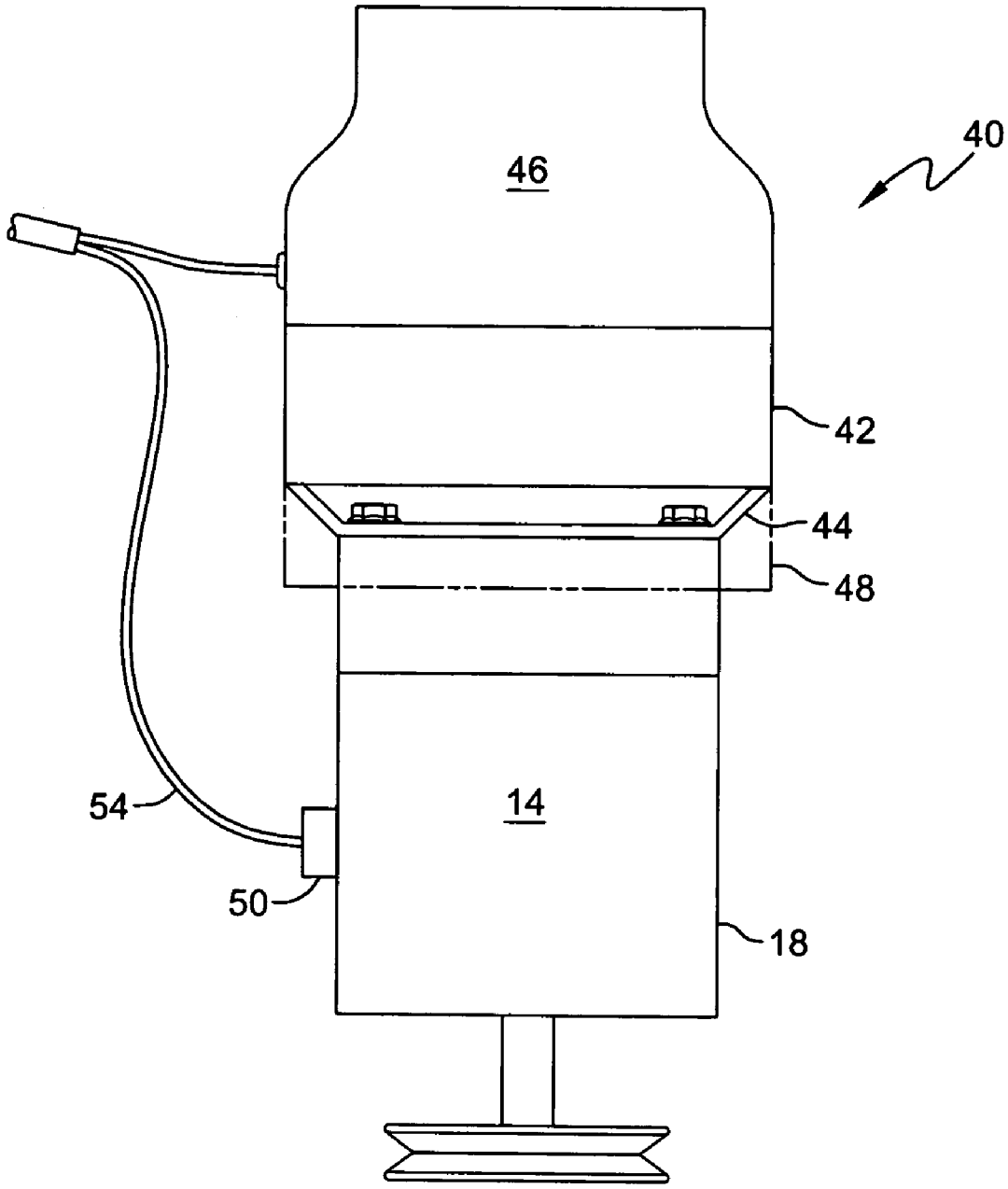
FIG. 2 is a side elevational view of a hydraulic pump shown in FIG. 1.

FIG. 2 shows a detailed view of a first embodiment of a pump assembly 40. Assembly 40 comprises a fan 42 which is attached to pump 14 by means of bracket 44. Fan 42 preferably comprises a plurality of blades (not shown) shaped in a known manner to force air flow in the chosen direction. Bracket 44 may either be formed as a part of fan 42 and secured to housing 18 or it may be a separate bracket attached to both fan 42 and housing 18 by means of bolts or the like. Assembly 40 also comprises an upper shroud 46 that may aid in guiding air from a cooler region to fan 42 as well as providing a safety feature by isolating fan 42 to prevent inadvertent contact with the fan blades. In addition to upper shroud 46, a lower shroud 48 may optionally aid in directing air along the length of pump 14, thus increasing the cooling effect of fan 42.

In the preferred embodiment, fan 42 operates continuously once vehicle 10 is operating. However, pump 14 may also include a controller 50 that senses the temperature of pump 14 and operates fan 42 accordingly. As the temperature of pump 14 increases the speed of fan 42 may be increased by the action of controller 50, up to the maximum available speed of fan 42. Controller 50 may include a mode wherein pump 14 requires no cooling, such as might occur during cold weather operation, which would then keep fan 42 in an off condition and thus minimize the electrical load on vehicle 10. While controller 50 is shown as mounted external to pump 14, controller 50 may also be mounted internal to the housing of pump 14 and electrical leads 54 would be routed through housing 18 of pump 14.

Figure 3:
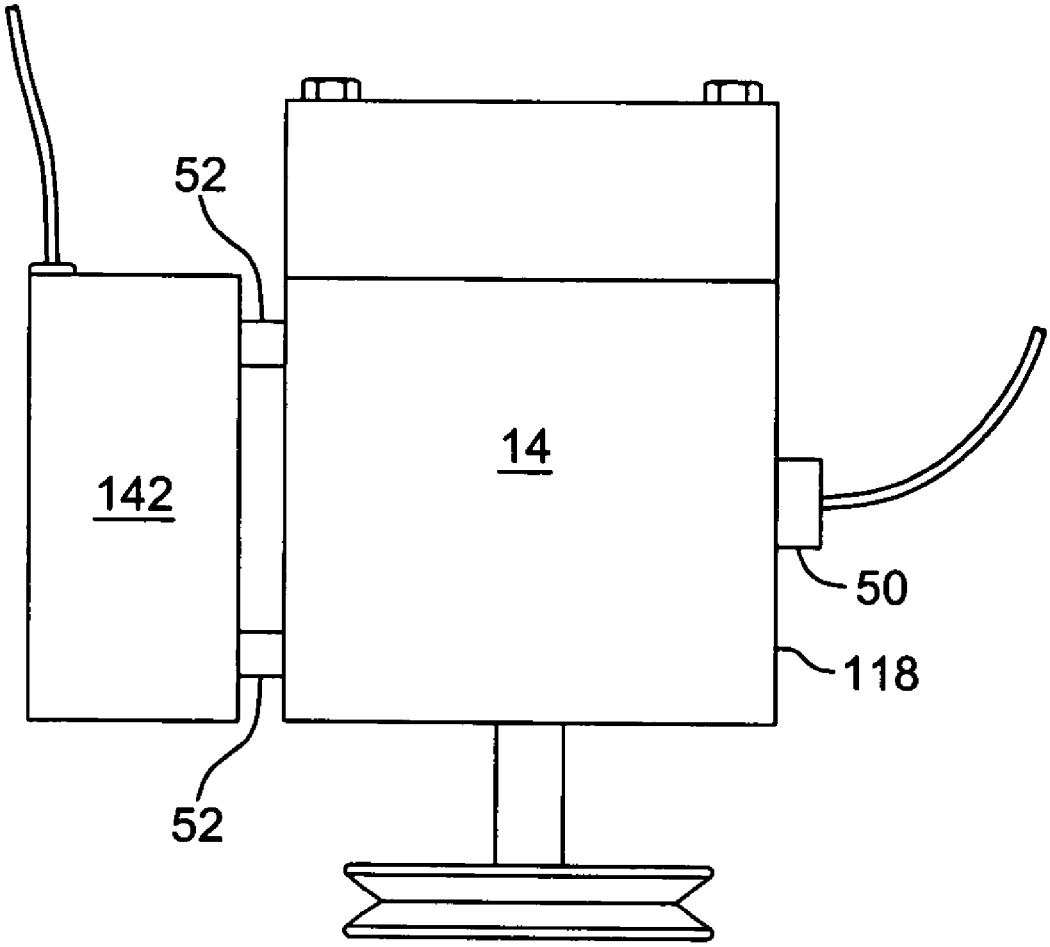
FIG. 3 is a side elevational view of a hydraulic pump incorporating a second embodiment of the present invention.

FIG. 3 shows a further embodiment of the invention wherein fan 142 is mounted on a side of pump housing 118. Mounting bosses 52 may be formed as a part of housing 118 or may be formed as a part of fan 142. In either situation, fan 142 would then be attached to pump 14 by fasteners threaded into housing 118 of pump 14.

Figure 4:
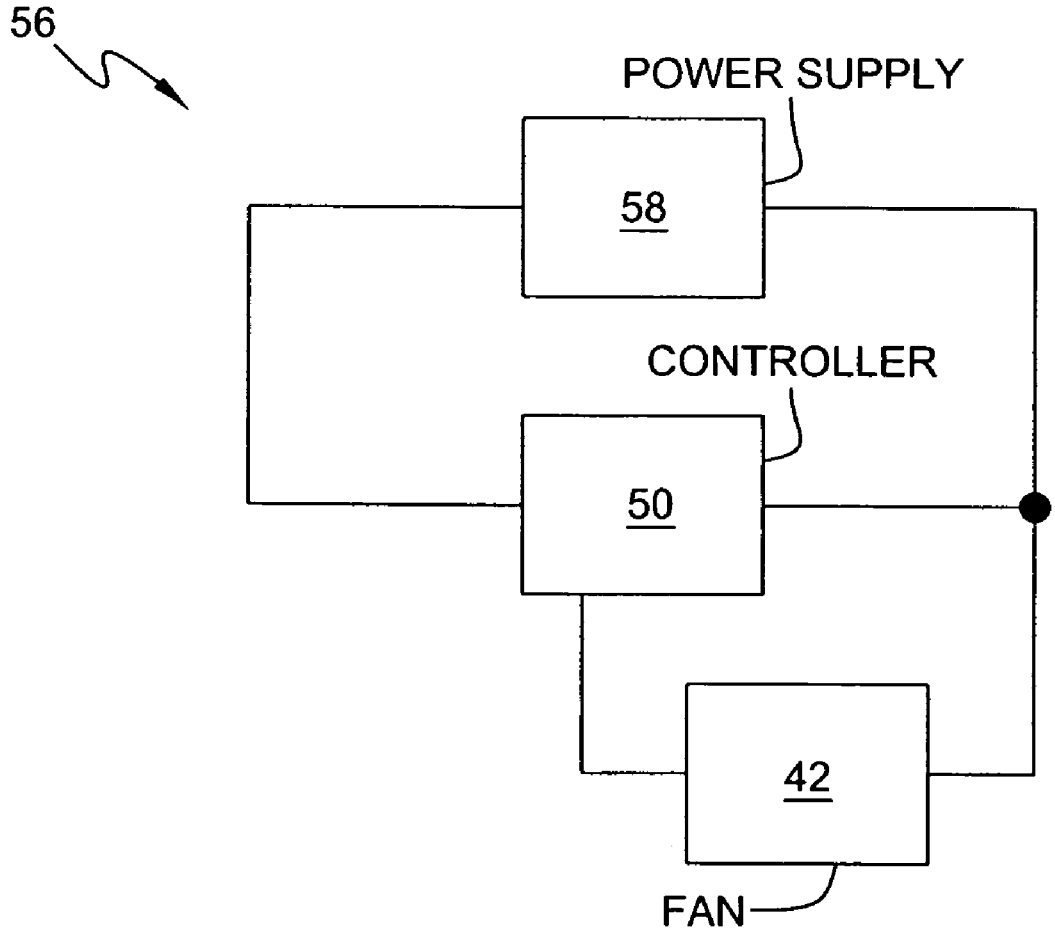
FIG. 4 is a block diagram of a circuit for controlling the fan.

FIG. 4 depicts a block diagram 56 illustrating a general connection of fan 42 and controller 50 in accordance with the embodiment shown in FIG. 3. A voltage source 58, which may be a battery or other source of DC or AC current, is connected to controller 50. Voltage is then supplied to fan 42 through controller 50.

It is to be understood that the above description of the invention should not be used to limit the invention, as other embodiments and uses of the various features of this invention will be obvious to one skilled in the art. This invention should be read as limited by the scope of its claims only.

We claim:

1. A hydraulic pump assembly comprising:

a hydraulic pump mounted in a pump housing;

an electric fan mounted on the pump housing and secured thereto by a bracket.

2. The hydraulic pump assembly as set forth in claim 1, wherein the fan is mounted on the top of the hydraulic pump.

3. The hydraulic pump assembly as set forth in claim 1, further comprising an upper shroud which envelops the fan and directs air from a cooler region to the fan.

4. The hydraulic pump assembly as set forth in claim 1, further comprising a lower shroud which directs air along the hydraulic pump.

5. The hydraulic pump assembly as set forth in claim 1, wherein the electric fan is secured to the pump housing by fasteners threaded into the pump housing.

6. The hydraulic pump assembly as set forth in claim 1, wherein the assembly further comprises a controller that senses the temperature of the hydraulic pump and actuates the fan such that the speed of the fan increases as the temperature of the hydraulic pump increases.

7. A hydraulic pump assembly comprising:

a hydraulic pump mounted in a pump housing;

an electric fan mounted on the pump housing and secured thereto by a bracket and fasteners threaded into the pump housing;

an upper shroud that envelops the fan and directs air from a cooler region to the electric fan;

a lower shroud that directs air along the hydraulic pump; and a controller that senses the temperature of the hydraulic pump and actuates the fan such that the speed of the fan increases as the temperature of the hydraulic pump increases.

8. A hydraulic pump assembly, comprising:

a pump housing having a first end, a second end and at least one side positioned between the first end and the second end;

a hydraulic pump mounted in the pump housing;

an input shaft drivingly engaged to the hydraulic pump and extending from the pump housing at the pump housing first end; and an electric fan attached to the pump housing, wherein the electric fan is rotatable with respect to the input shaft.

9. The hydraulic pump assembly as set forth in claim 8, wherein the electric fan is attached to the second end of the pump housing.

10. The hydraulic pump assembly as set forth in claim 8, wherein the electric fan is attached to the at least one side of the pump housing.

11. The hydraulic pump assembly as set forth in claim 8, further comprising a temperature sensor mounted on the pump housing, wherein the sensor cooperates with a controller to modify the speed at which the electric fan rotates.

12. The hydraulic pump assembly as set forth in claim 8, further comprising at least one bracket extending between and attached to the fan and the pump housing.

13. The hydraulic pump assembly as set forth in claim 8, further comprising an upper shroud that envelops the fan and directs air from a cooler region to the electric fan.

14. The hydraulic pump assembly as set forth in claim 13, further comprising a lower shroud that directs air along the hydraulic pump.

* * * * *